US011607888B2

(12) United States Patent
Kudo

(10) Patent No.: US 11,607,888 B2
(45) Date of Patent: Mar. 21, 2023

(54) LIQUID EJECTING APPARATUS

(71) Applicant: SEIKO EPSON CORPORATION, Tokyo (JP)

(72) Inventor: Koji Kudo, Shiojiri (JP)

(73) Assignee: SEIKO EPSON CORPORATION, Tokyo (JP)

( * ) Notice: Subject to any disclaimer, the term of this patent is extended or adjusted under 35 U.S.C. 154(b) by 5 days.

(21) Appl. No.: 17/486,240

(22) Filed: Sep. 27, 2021

(65) Prior Publication Data

US 2022/0097396 A1 Mar. 31, 2022

(30) Foreign Application Priority Data

Sep. 28, 2020 (JP) ..... JP2020-161839

(51) Int. Cl.
*B41J 2/175* (2006.01)
*B41J 2/165* (2006.01)

(52) U.S. Cl.
CPC ..... *B41J 2/17523* (2013.01); *B41J 2/16508* (2013.01); *B41J 2/17536* (2013.01)

(58) Field of Classification Search
CPC .... B41J 2/165; B41J 2/16505; B41J 2/16508; B41J 2/16526; B41J 2/16532; B41J 2/16536; B41J 2/16538; B41J 2/17513; B41J 2/1752; B41J 2/17523; B41J 2/17553
See application file for complete search history.

(56) References Cited

U.S. PATENT DOCUMENTS 6,540,321 B1 * 4/2003 Hirano ..... B41J 2/17546 347/22
6,899,417 B1 * 5/2005 Shinada ..... B41J 2/17513 347/86
7,033,006 B2 * 4/2006 Ebisawa ..... B41J 2/17509 347/85
7,134,747 B2 * 11/2006 Hayashi ..... B41J 2/17553 347/49
10,906,323 B2 2/2021 Nagaoka et al.
2003/0058315 A1 * 3/2003 Lee ..... B41J 2/17559 347/87

FOREIGN PATENT DOCUMENTS

JP 2013-158978 A 8/2013
JP 2017-052166 A 3/2017
JP 2020-049923 A 4/2020

* cited by examiner

*Primary Examiner* — Anh T Vo
(74) *Attorney, Agent, or Firm* — Oliff PLC

(57) ABSTRACT

A liquid ejecting apparatus includes an attachment section to which a liquid storage container having a storage chamber storing a liquid and a communication path communicating with the storage chamber is attached, and a liquid ejecting head configured to eject the liquid from nozzles. The attachment section includes an inlet through which the liquid from the attached liquid storage container flows, a protrusion having a connection port, a seal provided around the protrusion, and an air communication path communicating with the connection port and an air communication port that communicates with the air. The connection port enters the communication path of the attached liquid storage container, and the seal comes into contact with the liquid storage container attached to the attachment section.

4 Claims, 6 Drawing Sheets

LIQUID EJECTING APPARATUS

The present application is based on, and claims priority from JP Application Serial Number 2020-161839, filed Sep. 28, 2020, the disclosure of which is hereby incorporated by reference herein in its entirety.

BACKGROUND

1. Technical Field

The present disclosure relates to a liquid ejecting apparatus such as a printer.

2. Related Art

A liquid ejecting apparatus that discharges, from a recording head, which is an example liquid ejecting head, an ink, which is an example liquid, supplied from an ink cartridge, which is an example liquid storage container, for printing such as a recording apparatus is disclosed in, for example, JP-A-2020-49923. The ink cartridge has an air communication port that enables the interior of the ink cartridge to communicate with the air. The ink cartridge has a film sealing member that covers the air communication port.

The sealing member is deformed by the ink supplied from the ink cartridge, thereby enabling the air communication port to communicate with the air. More specifically, when no ink is supplied, the sealing member has a flat state, and when the ink is supplied, the sealing member acquires a concave state.

The sealing member is deformed repeatedly between the flat state and the concave state, and in some cases, the sealing member becomes distorted. A distorted sealing member may prevent the air communication port from communicating with the air appropriately.

SUMMARY

A liquid ejecting apparatus according to an aspect of the present disclosure for solving the above-described problem includes an attachment section to which a liquid storage container having a storage chamber storing a liquid and a communication path communicating with the storage chamber is attached, and a liquid ejecting head configured to eject the liquid from nozzles. The attachment section includes an inlet through which the liquid from the attached liquid storage container flows, a protrusion having a connection port, a seal provided around the protrusion, and an air communication path communicating with the connection port, which communicates with the air. The connection port enters the communication path of the attached liquid storage container, and the seal comes into contact with the liquid storage container attached to the attachment section.

DESCRIPTION OF EXEMPLARY EMBODIMENTS

Figure 1:
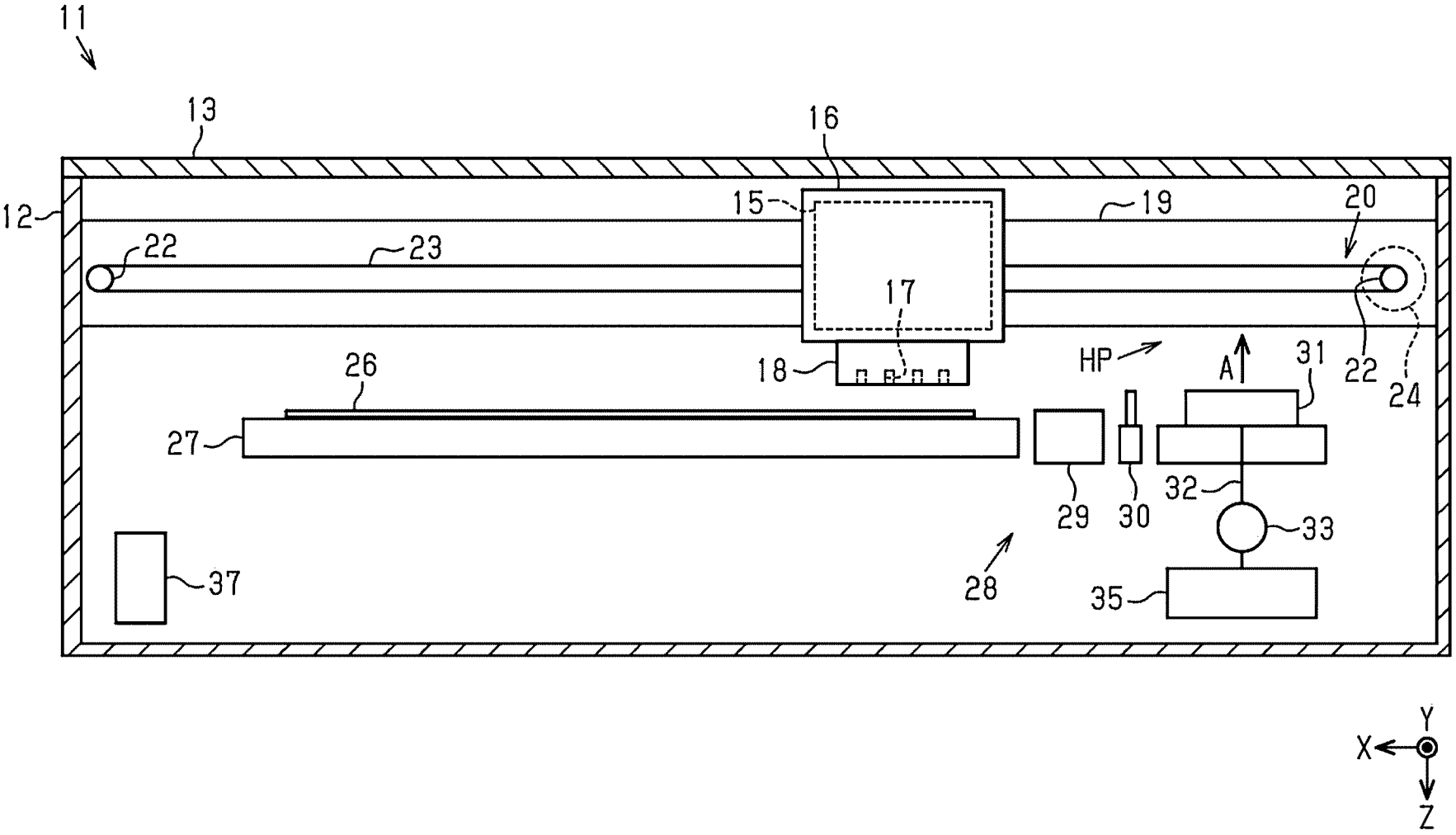
FIG. 1 is a schematic cross-sectional view of a liquid ejecting apparatus according to an embodiment.

Hereinafter, an embodiment of a liquid ejecting apparatus will be described with reference to the attached drawings. The liquid ejecting apparatus is, for example, an ink jet printer that performs printing by ejecting an ink, which is an example liquid, onto a medium, such as paper.

In the drawings, it is assumed that a liquid ejecting apparatus 11 is placed on a horizontal plane, and the Z-axis denotes the direction of gravity and the X-axis and the Y-axis denote directions along the horizontal plane. The X-axis, the Y-axis, and the Z-axis are orthogonal to each other.

As illustrated in FIG. 1, the liquid ejecting apparatus 11 may include a casing 12 and a top cover 13 provided on the casing 12. The top cover 13 can be opened or closed with respect to the casing 12. For example, the user opens the top cover 13 to expose the interior of the casing 12.

The liquid ejecting apparatus 11 includes an attachment section 16, to which a liquid storage container 15 is attached, and a liquid ejecting head 18 that ejects a liquid from nozzles 17. The liquid ejecting apparatus 11 may include a guiding section 19 and a moving mechanism 20.

The guiding section 19 extends along the X-axis. The guiding section 19 is, for example, a frame that supports the attachment section 16. The guiding section 19 guides the attachment section 16 and the liquid ejecting head 18 when they move. The attachment section 16 according to the embodiment functions also as a carriage that moves the liquid ejecting head 18 along the guiding section 19.

The moving mechanism 20 reciprocates the attachment section 16 parallel to the X-axis. The moving mechanism 20 according to the embodiment includes a pair of pulleys, an endless belt 23, and a motor 24. The pair of pulleys 22 are attached to the guiding section 19 at a given spacing. In this embodiment, the pair of pulleys 22 are provided at ends of the guiding section 19. The belt 23 is looped over the pair of pulleys 22, and a portion of the belt 23 is attached to the attachment section 16. The motor 24 is coupled to one of the pulleys 22. The belt 23 is rotated by the motor 24 to move the attachment section 16. The liquid ejecting head 18 ejects a liquid while moving together with the attachment section 16 to perform printing on a medium 26. In a non-printing state in which printing is not performed, the attachment section 16 and the liquid ejecting head 18 stand by at a home position HP.

A single liquid storage container 15 that stores a single type of liquid is attached to the attachment section 16 according to the embodiment. A plurality of liquid storage containers 15 may be attached to the attachment section 16. A single liquid storage container 15 may store a single type of liquid or a plurality of types of liquid which each type is divided in the single liquid container.

The liquid ejecting apparatus 11 may include a medium support section 27 for supporting the medium 26 and a maintenance section 28 that performs a maintenance operation for the liquid ejecting head 18. The maintenance section 28 may include a liquid receiving section 29 that receives a liquid ejected by the liquid ejecting head 18 in a flushing operation, a wiping section 30 that wipes the liquid ejecting head 18, and a cap 31 that covers the nozzles 17. The flushing operation is a maintenance operation for causing the liquid ejecting head 18 to eject a liquid not for printing but for suppressing an increase in viscosity of the liquid in the liquid ejecting head 18. The maintenance section 28 may include a discharge path 32 that is coupled to the cap 31 at an upstream end and a discharge pump 33 that is disposed in the discharge path 32.

The wiping section 30 moves between a wiping position at which the wiping section 30 wipes the liquid ejecting head 18 and a non-wiping position at which the wiping section 30 is not in contact with the liquid ejecting head 18. The wiping section 30 at the wiping position comes into contact with the liquid ejecting head 18 in a moving state to wipe the liquid ejecting head 18. The maintenance operation of the wiping section 30 for wiping the liquid ejecting head 18 is also referred to as wiping.

The cap 31 moves between a capping position at which the cap 31 comes into contact with the liquid ejecting head 18 and a retracted position at which the cap 31 is away from the liquid ejecting head 18. In this embodiment, a direction in which the cap 31 moves from the retracted position illustrated in FIG. 1 to the capping position is referred to as a moving direction A. The moving direction A according to the embodiment is parallel to the Z-axis.

The cap 31 at the capping position comes into contact with the liquid ejecting head 18 and, by using the liquid ejecting head 18, performs a capping operation to form an enclosed space, to which the nozzles 17 are open. The cap 31 performs a capping operation on the liquid ejecting head 18 that is at the home position HP. The home position HP is a position above the cap 31. The cap 31 moves from the capping position to the retracted position to open the enclosed space.

The discharge path 32 may be a tube that deforms as the cap 31 moves. A downstream end of the discharge path 32 is coupled to a waste liquid container 35 that stores a liquid discharged as a waste liquid from the liquid ejecting head 18. The discharge pump 33 reduces the pressure in the enclosed space formed by the cap 31 via the discharge path 32 to force the nozzles 17 to discharge a liquid. The discharged liquid is stored in the waste liquid container 35 as a waste liquid. The maintenance operation for reducing the pressure in the enclosed space to discharge a liquid is also referred to as suction cleaning.

The liquid ejecting apparatus 11 includes a controller 37 for controlling operations performed in the liquid ejecting head 18, the moving mechanism 20, the maintenance section 28, and other components. The controller 37 includes, for example, a computer and a processing circuit including a memory and controls a variety of operations performed in the liquid ejecting apparatus 11 in accordance with a program stored in the memory.

Figure 2:
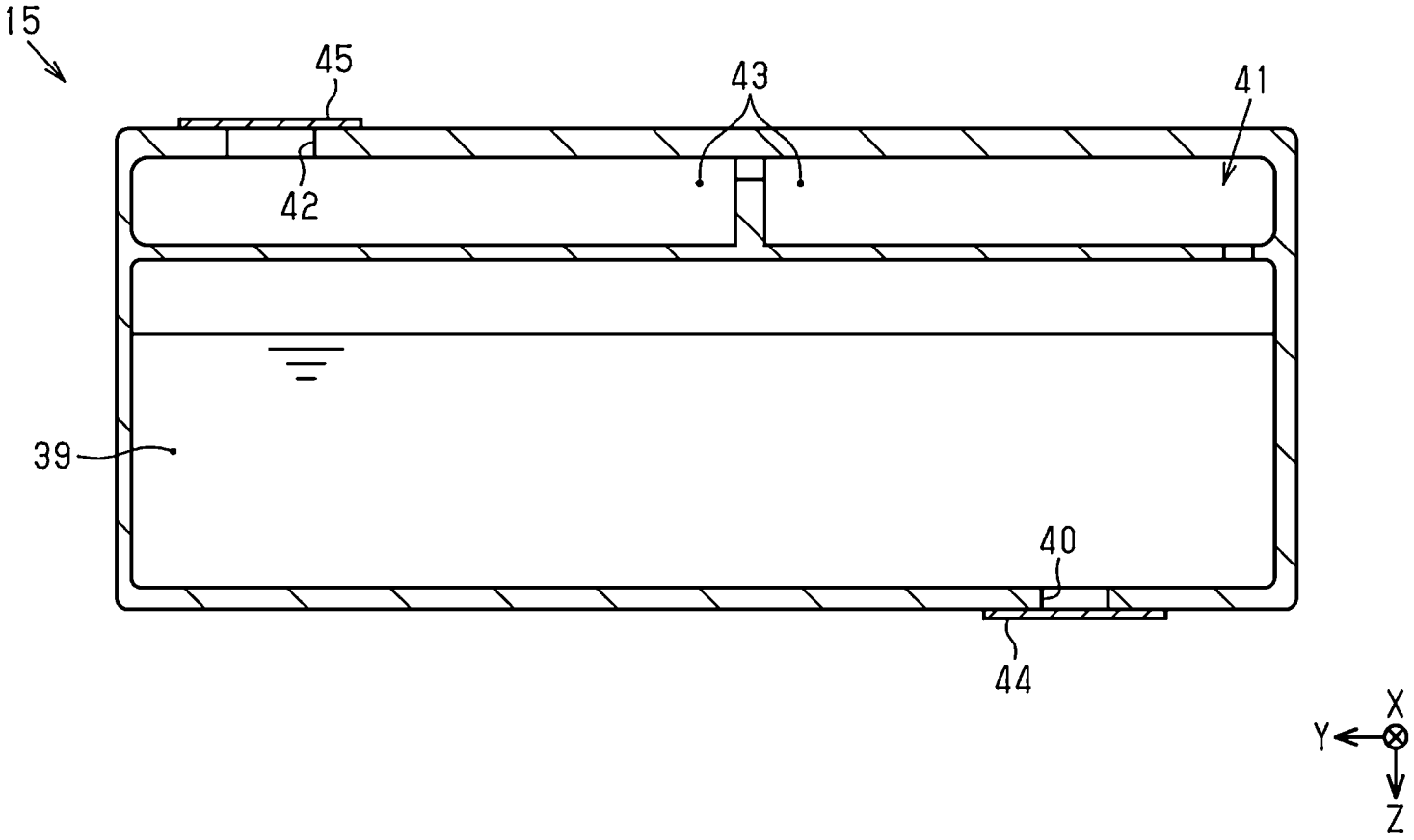
FIG. 2 is a schematic cross-sectional view of a liquid storage container.

As illustrated in FIG. 2, the liquid storage container 15 may include a storage chamber 39 that stores a liquid, an outlet 40 that enables the liquid to flow to the outside, and a communication path 41 that communicates with the storage chamber 39. The communication path 41 is a flow channel that couples a communication hole 42 and the storage chamber 39 to each other. The communication path 41 may have an air chamber 43 that is a space having a partly increased volume. The communication path 41 may have a plurality of air chambers 43. The communication hole 42 according to the embodiment has a circular shape. The liquid storage container 15 may include a protection member 44 that protects the outlet 40 and a film 45 that covers the communication hole 42 from the outside. When the liquid storage container 15 is at an attachment position at which the liquid storage container 15 is attached to the attachment section 16, the communication path 41 is above the storage chamber 39 or above a liquid level of a liquid stored in the storage chamber 39.

Figure 3:
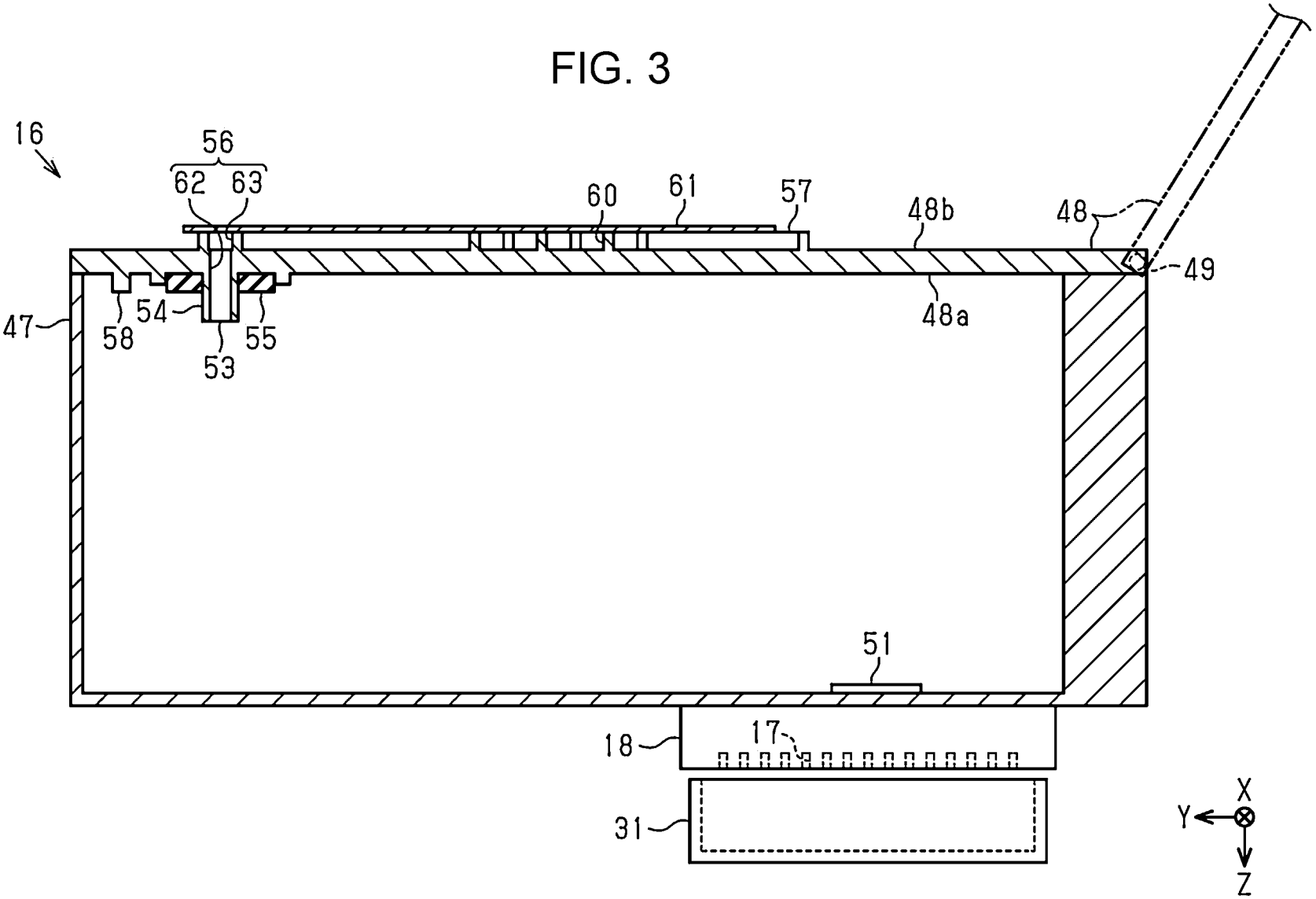
FIG. 3 is a schematic cross-sectional view of an attachment section.

As illustrated in FIG. 3, the attachment section 16 may include a body 47 and a cover 48 that is moved with respect to the body 47. The body 47 is supported by the guide section 19. The body 47 is capable of housing the liquid storage container 15. The cover 48 according to the embodiment includes a shaft 49 at a base end and rotates about the shaft 49. The cover 48 is moved to a closed position indicated by the solid line in FIG. 3 and to an open position indicated by the chain double-dashed line in FIG. 3 at which the top is raised from the closed position. The shaft 49 is supported by the body 47. With this structure, the cover 48 can be opened or closed with respect to the body 47.

The attachment section 16 includes an inlet 51 through which the liquid from the attached liquid storage container 15 flows. The inlet 51 according to the embodiment is provided in the body 47. The liquid stored in the liquid storage container 15 is supplied to the liquid ejecting head 18 through the inlet 51.

The attachment section 16 includes a protrusion 54 that has a connection port 53, a seal 55 that is provided around the protrusion 54, and an air communication path 56. The air communication path 56 communicates with the connection port 53 and an air communication port 57 that communicates with the air. The protrusion 54, the seal 55, and the air communication path 56 may be provided in the cover 48. The cover 48 may include a pressing section 58 that presses the attached liquid storage container 15.

The protrusion 54 protrudes from an inner surface 48*a* of the cover 48. The protrusion 54 according to the embodiment has a cylindrical shape. An outer diameter of the protrusion 54 is smaller than an inner diameter of the communication hole 42. An outer diameter of the seal 55 is larger than the inner diameter of the communication hole 42. The seal 55 is made of an elastic member such as rubber. The air communication port 57 may be provided in an outer surface 48*b* that is opposite to the inner surface 48*a* in the cover 48.

The cover 48 may include a groove 60 on the outer surface 48*b* and a groove cover 61 that covers the groove 60. The groove cover 61 may be a flexible sheet or a rigid plate. The air communication path 56 may include a path 62 that extends through the protrusion 54 and a fine path 63 defined by the groove 60 and the groove cover 61. One end of the path 62 is open and functions as the connection port 53 and the other end is coupled to the fine path 63.

Figure 4:
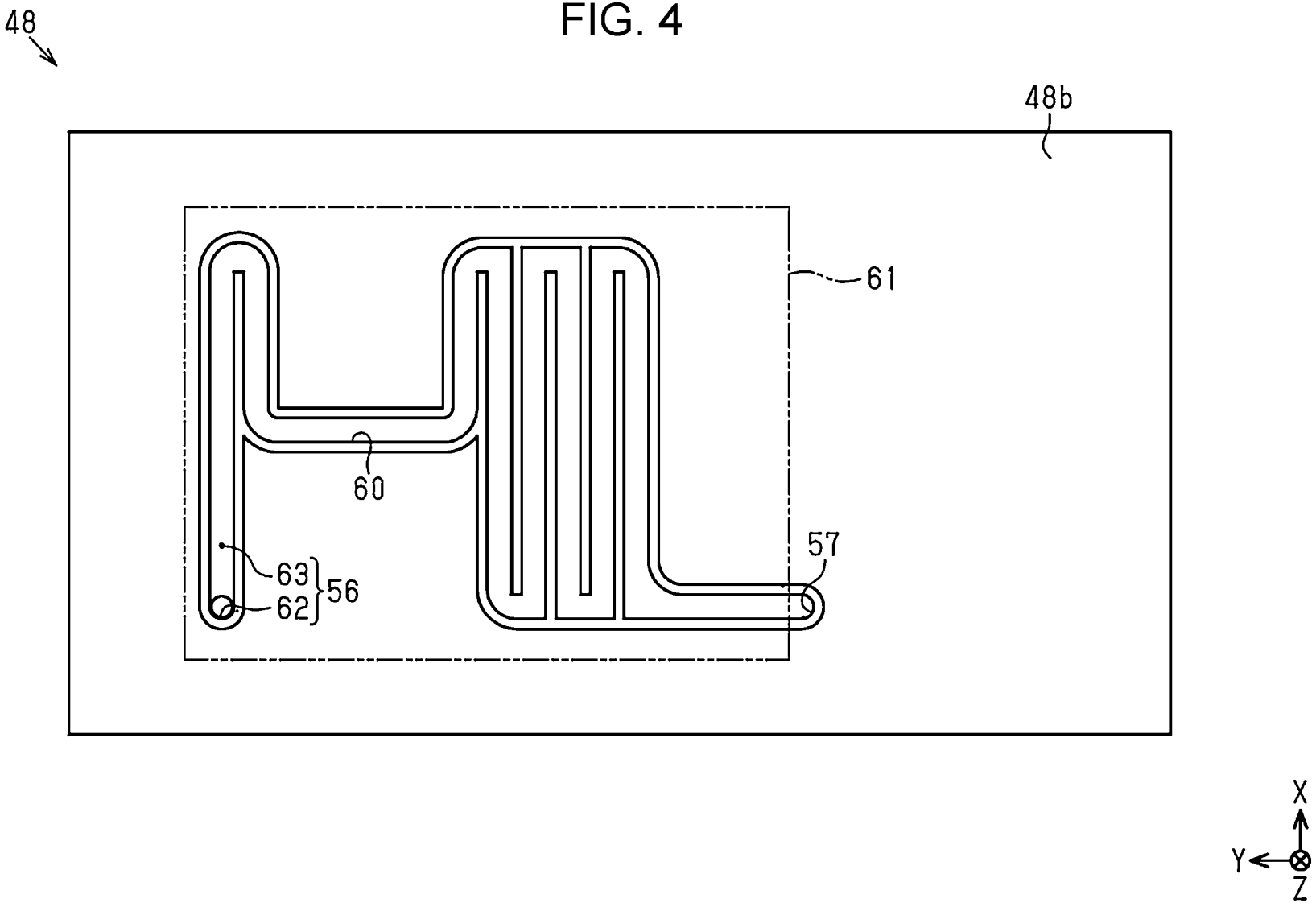
FIG. 4 is a schematic plan view of a cover.

As illustrated in FIG. 4, the groove cover 61 is in contact with a top of the groove 60 to define the fine path 63, and a portion of the groove 60 is exposed to define the air communication port 57. The air communication port 57 is provided at the other end of the fine path 63 that is opposite to the end coupled to the path 62. The fine path 63 may be a narrow winding path so as to intensely regulate the flow of liquid with respect to the flow of air.

Figure 5:
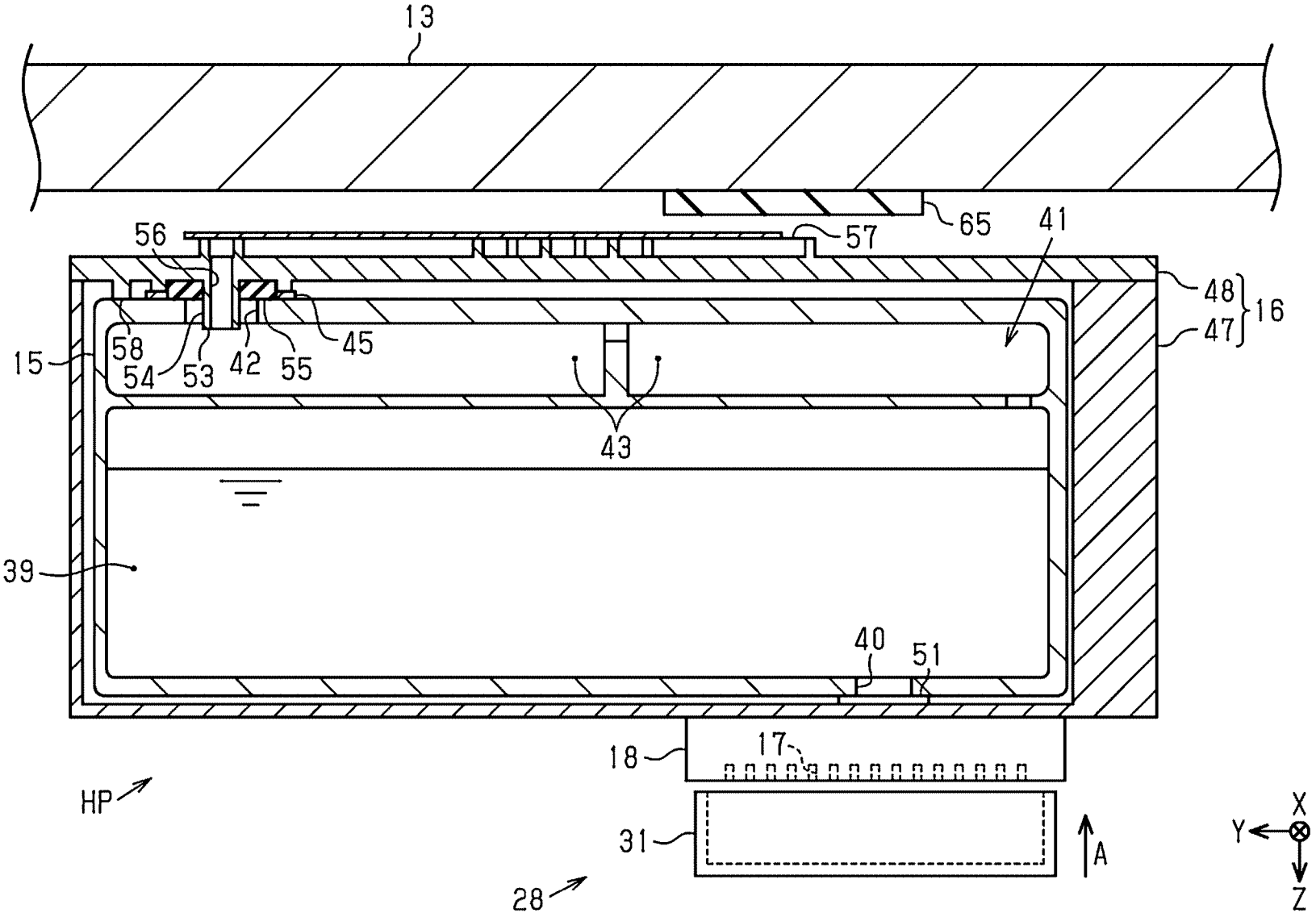
FIG. 5 is a schematic cross-sectional view of an attachment section with a liquid storage container attached thereto.

As illustrated in FIG. 5, the liquid ejecting apparatus 11 may include a cover member 65 that is capable of covering the air communication port 57. The cover member 65 according to the embodiment is provided on the top cover 13. The cover member 65 may be made of an elastic member, such as rubber. When the attachment section 16 is at the home position HP, the cap 31, the liquid ejecting head 18, the air communication port 57, and the cover member 65 may be arranged in the moving direction A in which the cap 31 moves.

Operations according to the embodiment will be described. As illustrated in FIG. 2 and FIG. 3, the liquid storage container 15 is attached to the attachment section 16 in a state in which the top cover 13 and the cover 48 are open. The liquid storage container 15 may be attached to the attachment section 16 in a state in which the protection member 44 is removed. Attaching the liquid storage container 15 to the attachment section 16 couples the outlet 40 to the inlet 51.

As illustrated in FIG. 5, when the cover 48 is moved to the closed position when the liquid storage container 15 is housed in the body 47, the protrusion 54 is inserted into the communication hole 42. Accordingly, when the cover 48 is moved to the closed position, the connection port 53 enters the communication path 41 of the attached liquid storage container 15. During the operation, the protrusion 54 tears the film 45. The seal 55 comes into contact with the liquid storage container 15 attached to the attachment section 16, thereby coupling the communication path 41 to the air communication path 56 in an airtight state.

Figure 6:
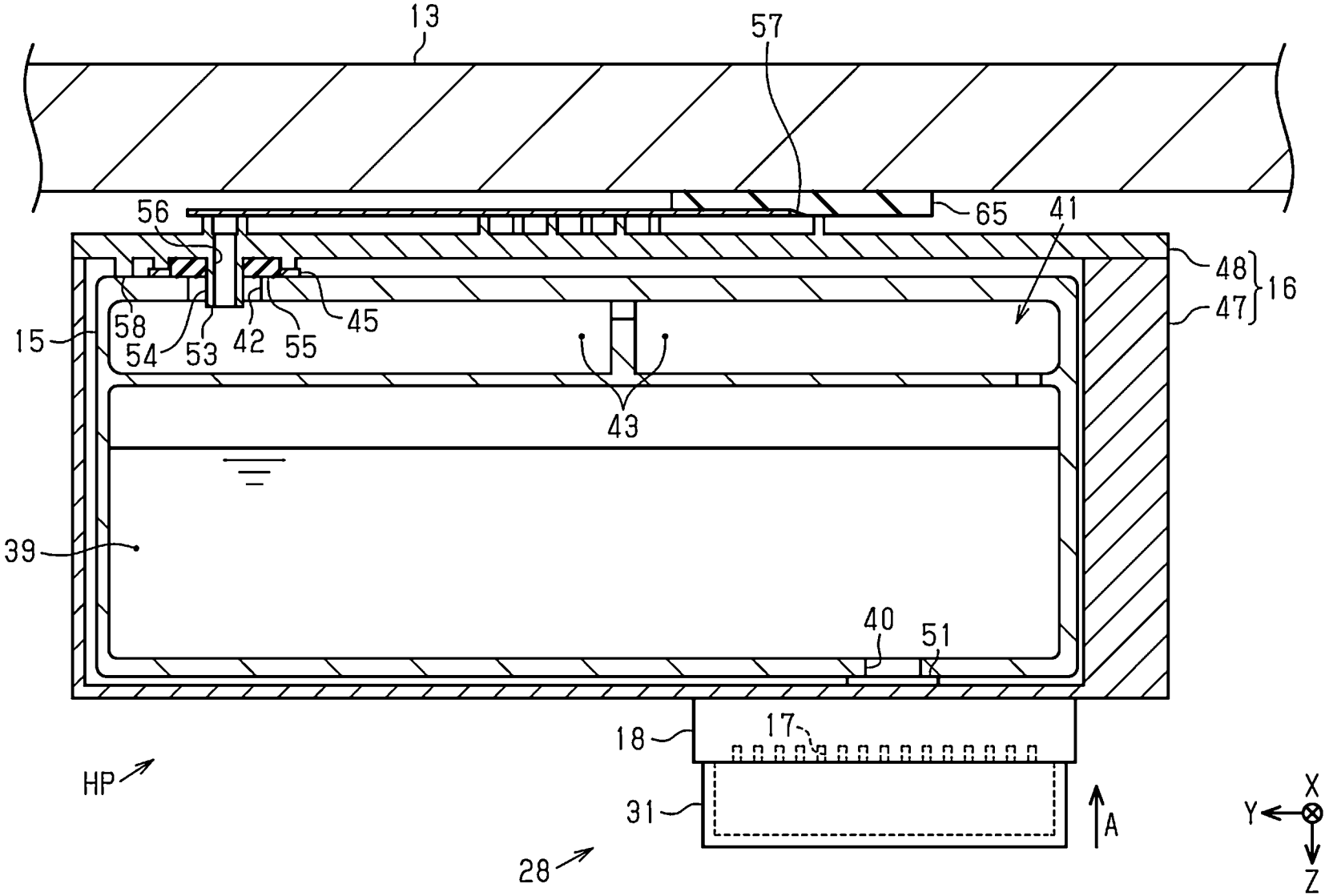
FIG. 6 is a schematic cross-sectional view of an attachment section in which an air communication port is covered.

The cap 31 of the maintenance section 28 is moved from the retracted position in FIG. 5 to the capping position in FIG. 6 and performs a capping operation on the liquid ejecting head 18.

As illustrated in FIG. 6, the cap 31 of the maintenance section 28 is pressed against the liquid ejecting head 18 to move the liquid ejecting head 18 and the attachment section 16. The maintenance section 28 moves the liquid ejecting head 18 and the attachment section 16 for maintenance, thereby pressing the air communication port 57 against the cover member 65. The air communication port 57 is covered by the cover member 65.

Advantages of the embodiment will be described.

1. The connection port 53 that is open in the protrusion 54 enters the communication path 41 of the liquid storage container 15 attached to the attachment section 16. Accordingly, the protrusion 54 is inserted into the communication path 41, thereby enabling the protrusion 54, for example, to tear the film 45 when the communication path 41 is covered by the film 45. The attachment section 16 includes the seal 55 provided around the protrusion 54. The seal 55 comes into contact with the liquid storage container 15 attached to the attachment section 16, thereby coupling the air communication path 56 and the communication path 41. With this structure, the interior of the liquid storage container 15 can appropriately communicate with the air.

2. The maintenance section 28 presses the air communication port 57 against the cover member 65 for the maintenance of the liquid ejecting head 18. That is, the air communication path 56 is blocked by the cover member 65. With this structure, in a maintenance operation in which no printing is performed on the medium 26, evaporation of the liquid stored in the storage chamber 39 through the communication path 41 and the air communication path 56 can be suppressed.

3. The cap 31 of the maintenance section 28 is pressed against the liquid ejecting head 18 to move the liquid ejecting head 18 and the attachment section 16. Accordingly, the capping operation of covering the nozzles 17 by using the cap 31 can block the air communication path 56.

4. The cap 31, the liquid ejecting head 18, the air communication port 57, and the cover member 65 are arranged in the moving direction A in which the cap 31 moves. This arrangement enables the cap 31 to press the liquid ejecting head 18 to readily press the air communication port 57 against the cover member 65.

5. The cover 48 includes the protrusion 54, and by moving the cover 48 with respect to the body 47 that houses the liquid storage container 15, the air communication path 56 can be readily coupled to the communication path 41. The cover 48 includes the seal 55, simplifying the structure of the liquid storage container 15 compared with a structure in which, for example, the liquid storage container 15 includes the seal 55.

This embodiment may be modified and implemented as follows. The embodiment and the following modifications may be combined with each other within a technically consistent scope. The cap 31 may perform a suction cleaning operation in the moving direction A at a cleaning position (not illustrated) between the retracted position in FIG. 5 and the capping position in FIG. 6. At the cleaning position, the cap 31 defines the enclosed space together with the liquid ejecting head 18, but the cap 31 does not press the liquid ejecting head 18 upward.

The discharge path 32 and the discharge pump 33 may be omitted from the maintenance section 28. For example, the liquid ejecting apparatus 11 may perform a pressure cleaning operation by pressurizing the liquid in the liquid ejecting head 18. The liquid discharged by the pressure cleaning operation may be received by the liquid receiving section 29.

The liquid ejecting apparatus 11 may include an adjustment mechanism for adjusting the size of the space between the medium support section 27 and the liquid ejecting head 18. The adjustment mechanism may move the liquid ejecting head 18 and the attachment section 16 parallel to the Z-axis for adjustment. The adjustment mechanism may move the liquid ejecting head 18 and the attachment section 16 that are at the home position HP, for example, in a non-printing state or in a power-off state. For example, the adjustment mechanism may raise the liquid ejecting head 18 and the attachment section 16 such that the air communication port 57 comes into contact with the cover member 65. The cap 31 may perform a capping operation on the liquid ejecting head 18 in a state in which the air communication port 57 is covered.

The body 47 may include the protrusion 54. The body 47 may include the seal 55. The cover 48 may be omitted from the attachment section 16. The connection port 53 may enter the communication path 41 when the liquid storage container 15 is attached to the body 47.

The air communication port 57 may be provided off a virtual line that passes through the cap 31 and the liquid ejecting head 18. The cover member 65 may be provided off a virtual line that passes through the cap 31 and the liquid ejecting apparatus 11. For example, the groove 60 and the groove cover 61 may be omitted from the cover 48, and the air communication path 56 may be defined by the communication hole 42. In such a case, the bottom of the communication hole 42 is the connection port 53 and the top of the communication hole 42 is the air communication port 57. The cover member 65 may be provided above the communication hole 42.

The cover member 65 may be movable. For example, the cover member 65 may be moved together with the cap 31. For example, the air communication port 57 may be provided in the bottom of the attachment section 16. The cover member 65 may be raised together with the cap 31 to cover the air communication port 57 when the cap 31 that is disposed below the liquid ejecting head 18 is raised for capping.

The air communication port 57 may be provided in a side of the attachment section 16. The air communication port 57 and the cover member 65 may be arranged in a scanning direction in which the attachment section 16 and the liquid ejecting head 18 are moved. For example, the cover member 65 may cover the air communication port 57 of the attachment section 16 that is at the home position HP. The cover member 65 may release the air communication port 57 as the attachment section 16 is moved away from the home position HP.

The cover member 65 may be omitted from the liquid ejecting apparatus 11. The cover member 65 may cover a portion in the air communication path 56. The air communication port 57 may be provided in the inner surface 48*a* of the cover 48.

The air communication path 56 may be provided in both the cover 48 and the body 47. For example, the air communication port 56 may be divided when the cover 48 is in the open position and may be in communication with the connection port 53 and the air communication port 57 when the cover 48 is in the closed position.

The liquid ejecting apparatus 11 may include a carriage that moves the liquid ejecting head 18 and may be an off-carriage apparatus that includes the attachment section 16 that is separated from the carriage. The attachment section 16 may be fixed, for example, to the casing 12. The liquid ejecting apparatus 11 may include a liquid supply flow path for supplying a liquid from the liquid storage container 15 attached to the attachment section 16 to the liquid ejecting head 18.

The liquid ejecting apparatus 11 may include an image reading mechanism for reading document images. The image reading mechanism may be provided, for example, on the top cover 13. The liquid ejecting apparatus 11 may be a liquid ejecting apparatus that ejects or discharges liquid other than ink. The forms of the liquid discharged as minute liquid droplets from the liquid ejecting apparatus include granular droplets, tear droplets, and stringy droplets. The liquid here may be any material that can be discharged from the liquid ejecting apparatus. For example, the liquid may be any material in a liquid phase, including a liquid having high or low viscosity, or a fluid material such as a sol, gel water, an inorganic solvent, an organic solvent, a solution, a liquid resin, a liquid metal, or a metal melt. Examples of the liquid are not limited to liquids that are in one material state and include liquids in which particles of a functional material composed of a solid material such as a pigment or metal particles are dissolved, dispersed, or mixed in a solvent. Typical examples of the liquid include the ink described in the above embodiment, liquid crystal, and the like. The ink may include inks that contain a variety of liquid compositions, such as a general water-based ink, an oil-based ink, a gel ink, a hot melt ink, and the like. The liquid ejecting apparatus may be, for example, a liquid ejecting apparatus that discharges a liquid containing a dispersed or dissolved material such as an electrode material or a color material to be used for manufacturing liquid crystal displays, electroluminescence (EL) displays, field emission displays (FEDs), or color filters. The liquid ejecting apparatus may be an apparatus that discharges a bioorganic material to be used for manufacturing biochips, an apparatus that is used as a precision pipette and discharges a liquid that is used as a sample, a textile printing apparatus, a micro dispenser, or the like. The liquid ejecting apparatus may be an apparatus that discharges lubricating oil with pinpoint precision onto a precision device, such as a watch, a camera, or the like, or an apparatus that discharges a transparent resin liquid such as an ultraviolet curing resin onto a substrate to form a micro hemispherical lens, an optical lens, or the like to be used as an optical component or the like. The liquid ejecting apparatus may be an apparatus that discharges an etching solution, such as an acid or an alkali to etch a substrate or the like.

Technical concepts understood from the above-described embodiments and modifications and their advantages will be described below.

A. The liquid ejecting apparatus includes an attachment section to which a liquid storage container having a storage chamber storing a liquid and a communication path communicating with the storage chamber is attached and includes a liquid ejecting head configured to eject the liquid from nozzles. The attachment section includes an inlet through which the liquid from the attached liquid storage container flows, a protrusion having a connection port, a seal provided around the protrusion, and an air communication path communicating with the connection port and an air communication port, which communicates with the air. The connection port enters the communication path of the attached liquid storage container, and the seal comes into contact with the liquid storage container attached to the attachment section.

With this structure, the connection port that is open in the protrusion enters the communication path of the liquid storage container attached to the attachment section. Accordingly, the protrusion is inserted into the communication path, thereby enabling the protrusion, for example, to tear the film when the communication path is covered by a film. The attachment section includes a seal provided around the protrusion. The seal comes into contact with the liquid storage container attached to the attachment section, thereby coupling the air communication path and the communication path. With this structure, the interior of the liquid storage container can appropriately communicate with the air.

B. The liquid ejecting apparatus may include a maintenance section configured to perform a maintenance operation on the liquid ejecting head and may include a cover member configured to cover the air communication port. The maintenance section may move the liquid ejecting head and the attachment section for maintenance to press the air communication port against the cover member.

With this structure, the maintenance section presses the air communication port against the cover member for the maintenance of the liquid ejecting head. That is, the air communication path is blocked by the cover member. With this structure, in a maintenance operation in which no printing is performed on the medium, evaporation of a liquid stored in the storage chamber through the communication path and the air communication path can be suppressed.

C. The maintenance section of the liquid ejecting apparatus may include a cap configured to cover the nozzles, and the cap may be pressed against the liquid ejecting head to move the liquid ejecting head and the attachment section.

With this structure, the cap of the maintenance section is pressed against the liquid ejecting head to move the liquid ejecting head and the attachment section. Accordingly, the capping operation of covering the nozzles by using the cap can block the air communication path.

D. The cap, the liquid ejecting head, the air communication port, and the cover member of the liquid ejecting apparatus may be arranged in a cap movement direction. With this structure, the cap, the liquid ejecting head, the air communication port, and the cover member are arranged in the cap movement direction, thereby enabling the cap to press the liquid ejecting head to readily press the air communication port against the cover member.

E. The attachment section of the liquid ejecting apparatus may include a body having the inlet and may include a cover configured to be moved with respect to the body, and the protrusion and the seal may be provided in the cover.

With this structure, the cover includes the protrusion; accordingly, by moving the cover with respect to the body that houses the liquid storage container, the air communication path can be readily coupled to the communication path. The cover includes the seal, simplifying the structure of the liquid storage container compared with a structure in which, for example, the liquid storage container includes the seal.

What is claimed is:

1. A liquid ejecting apparatus comprising:

an attachment section to which a liquid storage container having a storage chamber storing a liquid and a communication path communicating with the storage chamber is attached; and a liquid ejecting head configured to eject the liquid from nozzles, wherein the attachment section comprises:

an inlet through which the liquid from the attached liquid storage container flows;

a protrusion having a connection port;

a seal provided around the protrusion; and an air communication path communicating with the connection port and an air communication port that communicates with the air, wherein the connection port enters the communication path of the attached liquid storage container, and the seal comes into contact with the liquid storage container attached to the attachment section, and the liquid ejecting apparatus further comprises:

a maintenance section configured to perform a maintenance operation on the liquid ejecting head; and a cover member configured to cover the air communication port, wherein the maintenance section moves the liquid ejecting head and the attachment section for maintenance to press the air communication port against the cover member.

2. The liquid ejecting apparatus according to claim 1, wherein the maintenance section comprises a cap configured to cover the nozzles, and the cap is pressed against the liquid ejecting head to move the liquid ejecting head and the attachment section.

3. The liquid ejecting apparatus according to claim 2, wherein the cap, the liquid ejecting head, the air communication port, and the cover member are arranged in a moving direction in which the cap moves.

4. The liquid ejecting apparatus according to claim 1, wherein the attachment section comprises:

a body having the inlet; and a cover configured to be moved with respect to the body, wherein the protrusion and the seal are provided in the cover.

* * * * *